US005641453A

United States Patent [19]

Hackl et al.

[11] Patent Number: 5,641,453

[45] Date of Patent: Jun. 24, 1997

[54] IRON-BASED ALLOY FOR PLASTIC MOLDS

[75] Inventors: Gerhard Hackl, Kapfenberg; Karl Leban, Neustadt; Manfred Gstettner, Bohlerwerk, all of Austria

[73] Assignees: Bohler Edelstahl GmbH, Kapfenberg; Bohler Ybbstalwerke GmbH, Bohlerwerk, both of Austria

[21] Appl. No.: 585,732

[22] Filed: Jan. 16, 1996

[30] Foreign Application Priority Data

Jan. 16, 1995 [AT] Austria ..... 54/95

[51] Int. Cl.[6] ..... C22C 38/22; C22C 38/24

[52] U.S. Cl. ..... 420/42; 420/63; 420/69; 148/319; 148/325; 148/326

[58] Field of Search ..... 420/42, 63, 69; 148/319, 325, 326

[56] References Cited

U.S. PATENT DOCUMENTS 3,607,461 9/1971 Stanley ..... 420/42

FOREIGN PATENT DOCUMENTS 53-103918 9/1978 Japan ..... 420/69
54-115615 9/1979 Japan ..... 420/42

*Primary Examiner*—Deborah Yee
*Attorney, Agent, or Firm*—Greenblum & Bernstein P.L.C.

[57] ABSTRACT

The use of a chromium-containing martensitic alloy for plastic molds is described. The use properties of a thermally treated plastic mold of a hardness of at least 45 Rockwell C are improved by an iron-based alloy including, in weight-%,

| | |
|---|---|
| C | 0.25 to 1.0, preferably 0.4 to 0.8; |
| N | 0.10 to 0.35, preferably 0.12 to 0.29; |
| Cr | 14.0 to 25.0, preferably 16.0 to 19.0; |
| Mo | 0.5 to 3.0, preferably 0.8 to 1.5; and |
| V | 0.04 to 0.4, preferably 0.05 to 0.2, |

where the sum of the concentration of carbon and nitrogen results in a value of, in weight-%, at least 0.5 and no more than 1.2, preferably at least 0.61 and no more than 0.95, the remainder including iron and melt-related impurities.

11 Claims, No Drawings

IRON-BASED ALLOY FOR PLASTIC MOLDS

CROSS REFERENCE TO RELATED APPLICATIONS

This application claims the priority of Austrian Application No. 54/95, filed on Jan. 16, 1995, the disclosure of which is incorporated by reference herein in its entirety.

BACKGROUND OF THE INVENTION

1. Field of the Invention

The invention relates to the use of a chromium-containing, martensitic iron-based alloy for plastic molds.

2. Discussion of the Background of the Invention and Material Information

Iron-based alloys with a chromium content of more than 12% are generally used in the production of corrosion-resistant plastic molds for processing chemically-reactive molding compounds. Depending on the required (or desired) hardness of the material, heat-treatable Cr steel with 13.0% Cr and 0.2 or 0.4 weight-% C, for example in accordance with DIN Material Number 1.2082 and 1.2083, are employed. These iron-based alloys essentially containing carbon and chromium are easily and economically usable for less stressed molds, but they have the disadvantage that a sufficient service life of the mold (or tool) cannot be attained when subjected to highly corrosive molding compounds with wear-causing additives.

Iron-based alloys, for processing of plastics, which are more corrosion-resistant can be obtained by increasing the chromium content to 14.5 weight-% and increasing the carbon content to 0.48 weight-%, and adding 0.25 weight-% of molybdenum in accordance with DIN Material Number 1.2314. In practical use, such materials are mostly sufficiently resistant to chemical reactions but have, particularly in connection with molding materials containing mineral fibers, insufficient resistance to wear.

Improved use properties of plastic molds with respect to oxidation/corrosion and wear can be attained by comparably large chromium contents, large carbon contents and molybdenum and vanadium content of the steel used. The material No. 1.2361 in accordance with DIN constitutes an iron-based alloy typical for this use in connection with highly-stressed plastic molds. However, in the course of producing molds or tools from this alloy, it is possible that material distortion or uneven dimensional changes may occur, which often requires expensive finishing work or discarding of the worked part. As one skilled in the art knows, such uneven dimensional changes are essentially caused by a deformation texture or a linear arrangement of the carbides. If now, as has been proposed in the prior art, the carbon content and thus the carbide portion in the matrix is reduced, the wear resistance of the material in particular is also reduced. Further, the wear of the mold under large directional stress is increased and the service life reduced. A further disadvantage of a high carbon content is the low stretching ability and the reduced toughness of the steel.

SUMMARY OF THE INVENTION

It is an object of the present invention to avoid the above disadvantages and to propose a chromium-containing martensitic iron-based alloy for use with thermally treated plastic molds with a high corrosion resistance. The molds can be economically produced with the advantages of little dimensional change and improved use properties.

Accordingly, it is an aspect of the present invention to produce a thermally treated plastic molds including an iron-based alloy of the composition which includes, in weight-%,

| | |
|---|---|
| C | 0.25 to 1.0, preferably 0.4 to 0.8 |
| Si | up to 1.0 |
| Mn | up to 1.6, preferably 0.3 to 0.8 |
| N | 0.10 to 0.35, preferably 0.12 to 0.29 |
| Al | up to 1.0, preferably 0.002 to 0.8 |
| Co | up to 2.8 |
| Cr | 14.0 to 25.0, preferably 16.0 to 19.0 |
| Mo | 0.5 to 3.0, preferably 0.8 to 1.5 |
| Ni | up to 3.9, preferably up to 1.5 |
| V | 0.04 to 0.4, preferably 0.05 to 0.2 |
| W | up to 3.0 |
| Nb | up to 0.18 |
| Ti | up to 0.20 |

where the sum of the concentration of carbon and nitrogen results in a value of, in weight-%, at least 0.5 and no more than 1.2, preferably at least 0.61 and no more than 0.95, the remainder including iron and melt-related impurities. The thermally treated plastic molds produced according to the present invention also include a hardness of at least 45 Rockwell C, preferably 50 to 55 Rockwell C, and a high corrosion resistance.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the enclosed table making apparent to those skilled in the art how the several forms of the invention may be embodied in practice.

The advantages achieved by the present invention are essentially seen in the molded part or the workpiece showing a large extent isometric dimensional changes in the course of heat treatment. The corrosion resistance of the material is furthermore improved and its matrix has greater homogeneity. The mechanical properties and the wear resistance of the plastic molds made from the alloy used in accordance with the invention are clearly increased.

The improvement in properties of the mold material is due to the iron-based alloy, according to the present invention, containing nitrogen. Nitrogen is an element that is a strong austenite carrier and causes the creation of inter-metallic hard phases by combination with nitride-forming elements. According to the present invention, the concentrations of all essential alloy elements are synergetically matched with each other, taking into consideration the effect of nitrogen on the solidification, on the precipitation products, on the conversion kinetics during heat treatment, and on the corrosion and cracking behavior of the iron-based alloy. Thus, in accordance with the invention, the material for producing thermally treated plastic molds has considerably improved use properties.

These improved properties apply in particular to the capability to polish the plastic mold to a high gloss which is often required when using the mold in the electronics industry. While not all the reasons for this advantage have been completely explained scientifically, the following findings have been made: during solidification and deformation, as well as conventional heat treatment, the differences in the concentration of chromium in the matrix of the mold material used in accordance with the invention are small and the carbide proportion is also low in comparison with nitrogen-free martensitic chromium steels. This causes a high corrosion resistance and obviously a particular capability for high gloss polishing. However, Cr contents lower than 14 weight-% result in a sharply increased chemical reaction, in particular with organic acids. With chromium contents above 25 weight-%, signs of embrittling of the material when used as a plastic mold were observed. The best long term results were noted with Cr concentrations between approximately 16.0 and 18.0 weight-%.

To aid corrosion resistance or stabilization of the surface passive layer, a minimum content of approximately 0.5 weight-% of molybdenum is important, however, concentrations higher than approximately 3.0 weight-% can have a ferrite-stabilizing effect, which makes heat treatment of the alloy more difficult. Molybdenum nitride ($Mo_2N$) also shows particularly good results on the mechanical properties of the material, and in particular on the wear resistance, when the content of molybdenum is within the range of approximately 0.3 to 1.5 weight-%.

Vanadium has a very high affinity for carbon as well as nitrogen. The fine, dispersely distributed monocarbides (VC) or mononitrides (VN) and the mixed carbides are advantageously effective in the range between 0.04 to 0.4 weight-% of vanadium with respect to the material properties of the material in the heat-treated state. Particularly good hardness values and high tempering properties with good dimensional stability of the mold were achieved in the range between approximately 0.05 to 0.2 weight-% vanadium, which is probably a result of the germ effect of the small, homogeneously distributed vanadium compounds.

The summing effect of carbon and nitrogen in the iron-based alloy according to the present invention is of essential importance in the selected areas of concentration of the alloy metals. With a minimum concentration of carbon or nitrogen from 0.25 to 0.1 weight-%, the sum of the contents must be at last 0.5 weight-% in order to cause an advantageous interaction of the alloy elements, as mentioned above. With the sum of the contents in the range between 0.5 to 1.2 weight-% C+N, the fatigue strength, in particular during changing stresses as occur in plastic molds during filling cycles, was considerably increased. This is most likely the result of stabilizing the passive layer in the atomic or microscopic range and, thus, prevents an initiation of cracks due to local material reaction.

As has been found, nitrogen atoms could have an advantageous effect during changes in the corrosive stress of the material, something which will have to be investigated more closely. Furthermore, with the above sum of the contents, a destabilization of the cubic body centered lattice is obviously started, so that in a simple manner under heat treatment no areas with alpha and delta structures remain. This prevents the tendency of the material to crack due to corrosive stress. With the same hardness and wear resistance, a reduced carbide content is provided by alloying the chromium-containing martensitic steel with carbon and nitrogen. The matrix has an increased sturdiness which considerably improves the use properties of the highly stressed plastic mold. Although sum values of carbon and nitrogen higher than 1.2 weight-% cause extraordinary hardness during elaborate tempering and deep chilling treatment of the mold, they may also increase the danger of their breaking.

Within a range between approximately 0.61 to 0.95 weight-% of the sum of the content of carbon and nitrogen of the iron-based alloy, the longest service life of heat-treated plastic molds were made from this material. Further, the material within this range exhibits a material hardness of between approximately 50 and 55 Rockwell C, in particular when processing strongly chemically-reactive molding compounds with wear-causing additives. The adhesion of the plastic product or the molded body to the mold was considerably less than with low nitrogen concentrations in the alloy, particularly with high production numbers, which made the ejection of the molded material considerably easier. The cause for the reduction of the sliding friction on the mold wall has not yet been completely clarified.

Tungsten contents up to approximately 3.0 weight-% improve hardness and wear resistance, however, higher values have a negative effect on workability and tempering behavior of the material because of the great affinity of tungsten to carbon.

Niobium and/or titanium are monocarbide and mononitride formers at higher proportions. However, up to a concentration of approximately 0.18 weight-% or approximately 0.2 weight-% these elements are primarily stored in mixed carbide, improve the mechanical properties of the steel and considerably reduce the danger of overheating. Higher contents can increase the brittleness of the mold, in particular with a carbon content above approximately 0.7 weight-%.

Cobalt and nickel in small amounts up to approximately 2.8 weight-% or approximately 3.9 weight-% improve the toughness of the material. However, nickel, an austenite-forming element, should not exceed a concentration value of approximately 1.5 weight-% for the sake of hardening capability.

An improvement in the workability of the material can be achieved, as known per se, by adding sulfur to the alloy. The most advantageous values were found in a concentration range between approximately 0.02 and approximately 0.45 weight-% sulfur, and preferably between approximately 0.2 and 0.3 weight-% sulfur.

As extensive work has shown, it is advantageous for further hardening or increasing the wear resistance of the surface of the plastic molds made from an iron-based alloy in accordance with the invention, if a mechanically resistant coating, preferably produced by means of a CVD or PVD process, is formed on the working surface in particular.

For further clarification, the invention will be described below by means of examples which have been compiled in the following table. For this purpose eight iron-based alloys were used for plastic molds which were designed the same way and were particularly strongly, but in the same way, stressed chemically and by wear. The resulting values for the mold made from the DIN Material No. 1.2361, which is part of the prior art, were set at 100% in order to be able to show by comparison essential property values of other molds made from different materials. The respective values are rounded-off sum values. In this case the corrosion behavior, the mechanical properties, the fatigue strength, the mechanically resistant coating and the wear resistance number are better with higher resulting values, reduced dimensional stability and improved high-gloss polishing capability of the material are indicated by reduced characteristic numbers.

| No | Steel(DIN mat. no.) | Chemical composition C | Si | Mn | N | Al | Co | Cr | Mo | Ni | V | W |
|---|---|---|---|---|---|---|---|---|---|---|---|---|
| 1 | 1.2083 | 0.41 | 0.6 | 0.8 | — | — | — | 13.3 | — | — | — | — |
| 2 | 1.2314 | 0.48 | 0.4 | 0.43 | — | — | — | 14.8 | 0.27 | — | — | — |
| 3 | 1.2361 | 0.94 | 0.7 | 0.6 | — | — | — | 18.2 | 1.15 | 0.22 | 0.10 | — |
| 4 | KFE 1 | 0.47 | 0.5 | 0.65 | 0.15 | | | 16.2 | 1.35 | — | 0.12 | 0.2 |
| 5 | KFE 2 | 0.63 | 0.7 | 0.5 | 0.22 | | | 16.9 | 1.40 | — | 0.19 | 0.06 |
| 6 | KFE 3 | 0.70 | 0.7 | 0.48 | 0.24 | 0.6 | 0.2 | 17.8 | 0.82 | 0.8 | 0.06 | 0.7 |
| 7 | KFE 4 | 0.84 | 0.6 | 0.8 | 0.26 | | | 21.1 | 0.6 | — | 0.32 | 2.4 |
| 8 | KFE 5 | 1.04 | 0.8 | 0.71 | 0.19 | | | 15.8 | 1.7 | — | 0.25 | 2.8 |

| No | Steel(DIN mat. no.) | Chemical composition Nb | Ti | CiN | Study results A | B | C | D | E | F | G |
|---|---|---|---|---|---|---|---|---|---|---|---|
| 1 | 1.2083 | — | — | — | 40 | 100 | 80 | 30 | 100 | 40 | 110 |
| 2 | 1.2314 | — | — | — | 50 | 80 | 90 | 40 | 100 | 60 | 95 |
| 3 | 1.2361 | — | — | — | 100 | 100 | 100 | 100 | 100 | 100 | 100 |
| 4 | KFE 1 | 0.02 | | 0.62 | 190 | 30 | 250 | 400 | 250 | 270 | 45 |
| 5 | KFE 2 | — | | 0.85 | 210 | 35 | 230 | 350 | 250 | 280 | 38 |
| 6 | KFE 3 | 0.03 | 0.05 | 0.94 | 180 | 35 | 220 | 300 | 450 | 320 | 42 |
| 7 | KFE 4 | 0.15 | — | 1.10 | 190 | 40 | 300 | 200 | 250 | 340 | 40 |
| 8 | KFE 5 | 0.18 | 0.18 | 1.23 | 180 | 90 | 110 | 80 | 200 | 400 | 75 |

A . . . Corrosion resistance
B . . . Dimension changes
C . . . Mechanical properties
D . . . Standing time duration
E . . . Hard material inspection
F . . . Wear durability value
G . . . High gloss polishing capability (k-numeral)

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to all functionally equivalent structures, methods and uses, such as are within the scope of the appended claims.

What is claimed is:

1. A thermally treated plastic mold comprising an iron-based alloy comprising, in weight-%:

| | |
|---|---|
| C | 0.25 to 1.0; |
| Si | up to 1.0; |
| Mn | up to 1.6; |
| N | 0.10 to 0.35; |
| Al | up to 1.0; |
| Co | up to 2.8; |
| Cr | 14.0 to 25.0; |
| Mo | 0.5 to 3.0; |
| Ni | up to 3.9; |
| V | 0.04 to 0.4; |
| W | up to 3.0; |
| Nb | up to 0.18; and |
| Ti | up to 0.20, |

wherein a sum of a concentration of carbon and nitrogen results in a value of, in weight-%, between 0.5 and 1.2, and a remainder comprises iron and melt-related impurities;

said thermally treated plastic mold comprising a hardness of at least approximately 45 Rockwell C and at least one of a high corrosion resistance and high gloss polishing capability.

2. The thermally treated plastic mold according to claim 1, said iron-based alloy comprising, in weight-%, 0.02 to 0.45 sulfur.

3. The thermally treated plastic mold according to claim 1, comprising a working surface, on which a mechanically resistant coating is at least partially formed.

4. The thermally treated plastic mold according to claim 3, said mechanically resistant coating comprising at least one of carbide, nitride, and oxide in single or mixed form and at least one of the elements titanium and vanadium.

5. A thermally treated plastic mold comprising an iron-based alloy comprising, in weight-%:

| | |
|---|---|
| C | 0.4 to 0.8; |
| Si | up to 1.0; |
| Mn | 0.3 to 0.8; |
| N | 0.12 to 0.29; |
| Al | 0.002 to 0.8; |
| Co | up to 2.8; |
| Cr | 16.0 to 19.0; |
| Mo | 0.8 to 1.5; |
| Ni | up to 1.5; |
| V | 0.05 to 0.2; |
| W | up to 3.0; |
| Nb | up to 0.18; and |
| Ti | up to 0.20, |

wherein a sum of a concentration of carbon and nitrogen results in a value, in weight-%, of between 0.61 and 0.95, and a remainder comprises iron and melt-related impurities;

said thermally treated plastic mold comprising a hardness of at least approximately 45 Rockwell C and at least one of a high corrosion resistance and high gloss polishing capability.

6. The thermally treated plastic mold according to claim 2, said iron-based alloy comprising sulfur, in weight-%, between 0.2 and 0.3.

7. The thermally treated plastic mold according to claim 1, said thermally treated plastic mold comprising a hardness between 50 and 55 Rockwell C.

8. A chromium containing martensitic alloy comprising, in weight-%:

| | |
|---|---|
| C | 0.25 to 1.0; |
| Si | up to 1.0; |
| Mn | up to 1.6; |
| N | 0.10 to 0.35; |
| Al | up to 1.0; |
| Co | up to 2.8; |
| Cr | 14.0 to 25.0; |
| Mo | 0.5 to 3.0; |
| Ni | up to 3.9; |
| V | 0.04 to 0.4; |
| W | up to 3.0; |
| Nb | up to 0.18; and |
| Ti | up to 0.20, |

wherein a sum of a concentration of carbon and nitrogen results in a value of, in weight-%, between 0.5 and 1.2, and a remainder comprises iron and melt-related impurities.

9. The chromium containing martensitic alloy according to claim 8, said iron-based alloy comprising, in weight-%:

| | |
|---|---|
| C | 0.4 to 0.8; |
| Mn | 0.3 to 0.8; |
| N | 0.12 to 0.29; |
| Al | 0.002 to 0.8; |
| Cr | 16.0 to 19.0; |
| Mo | 0.8 to 1.5; |
| Ni | up to 1.5; and |
| V | 0.05 to 0.2, |

wherein said sum of said concentration of carbon and nitrogen results in a value, in weight-%, of between 0.61 and 0.95.

10. The chromium containing martensitic alloy according to claim 8, said iron-based alloy comprising, in weight-%, 0.02 to 0.45 sulfur.

11. The chromium containing martensitic alloy according to claim 10, said iron-based alloy comprising sulfur, in weight-%, between 0.2 and 0.3.

* * * * *